US012799750B2

(12) United States Patent
Fu

(10) Patent No.: US 12,799,750 B2
(45) Date of Patent: Nov. 17, 2026

(54) AUTO-ASSEMBLED-AND-FOLDED SUPPORT FRAME

(71) Applicant: Yang-Li Fu, Keelung City (TW)

(72) Inventor: Yang-Li Fu, Keelung City (TW)

( * ) Notice: Subject to any disclaimer, the term of this patent is extended or adjusted under 35 U.S.C. 154(b) by 262 days.

(21) Appl. No.: 18/773,872

(22) Filed: Jul. 16, 2024

(65) Prior Publication Data

US 2025/0283338 A1 Sep. 11, 2025

(30) Foreign Application Priority Data

Mar. 8, 2024 (TW) ..... 113108638
May 9, 2024 (TW) ..... 113117265

(51) Int. Cl.
*E04G 1/34* (2006.01)
*E04G 1/04* (2006.01)

(52) U.S. Cl.
CPC ..... *E04G 1/04* (2013.01); *E04G 1/34* (2013.01)

(58) Field of Classification Search
CPC ..... E04G 1/34; E04G 1/17; E04G 5/16
See application file for complete search history.

(56) References Cited

U.S. PATENT DOCUMENTS 153,270 A * 7/1874 Newhard ..... E04G 1/34 182/152
2,665,951 A * 1/1954 Bobst ..... E04G 1/14 182/180.1
2,948,363 A * 8/1960 Hopfeld ..... B66F 11/04 52/118
2,982,379 A 5/1961 Fisher
3,000,466 A * 9/1961 Johnson ..... E04G 1/34 182/152
3,105,572 A * 10/1963 Nesslinger ..... E04G 1/34 182/180.1
3,354,596 A 11/1967 Schafer
RE26,354 E 2/1968 Usher et al.
(Continued)

FOREIGN PATENT DOCUMENTS

CN 112031384 A * 12/2020 ..... E04G 1/24
DE 1559034 A1 * 8/1969
(Continued)

*Primary Examiner* — Daniel P Cahn
*Assistant Examiner* — Benjamin Alexander Pezzlo
(74) *Attorney, Agent, or Firm* — Birch, Stewart, Kolasch & Birch, LLP

(57) ABSTRACT

A support frame that can be assembled automatically includes multiple straight rod assemblies and multiple linkage assemblies. The straight rod assemblies are arranged at intervals in a rectangular shape. Each of the linkage assemblies connects two straight rod assemblies and comprises multiple upper rods, one joint seat connected to the upper rods, multiple lower rods, and one connecting seat connected to the lower rods. When the joint seat is attached to the connecting seat, the support frame and the straight rod assemblies are expanded. When the joint seat is detached from the connecting seat, the support frame and the straight rod assemblies are folded. All the actions can be easily achieved by operating a pressure ring assembly attached on the straight rod assemblies. The support frame is convenient for storage, saves transportation space, and can be automatically stacked and set up to form scaffolding with automated equipment.

12 Claims, 13 Drawing Sheets

(56) References Cited

U.S. PATENT DOCUMENTS

| | | | | | |
|---|---|---|---|---|---|
| 5,149,120 | A * | 9/1992 | Halliday | A61G 5/10 | 280/649 |
| 5,351,843 | A * | 10/1994 | Wichman | G09F 15/0062 | 211/195 |
| 6,119,810 | A * | 9/2000 | Harder | E04G 1/34 | 182/152 |
| 6,161,359 | A * | 12/2000 | Ono | E04G 1/14 | 52/646 |
| 6,799,594 | B2 * | 10/2004 | Kuo | G09F 15/0068 | 135/147 |
| 8,210,312 | B1 * | 7/2012 | Tetreault, Jr. | E04G 1/34 | 182/119 |
| 10,330,247 | B2 * | 6/2019 | Shimodaira | F16M 11/38 | |
| 2002/0141811 | A1 * | 10/2002 | Shih | E04G 25/065 | 403/49 |

FOREIGN PATENT DOCUMENTS

| | | | | |
|---|---|---|---|---|
| GB | 1067274 | A | 5/1967 | |
| KR | 102932367 | B1 * | 3/2026 | E04G 7/30 |
| TW | M314103 | U | 8/1997 | |
| TW | M375137 | U | 11/1999 | |
| TW | M323500 | U | 12/2007 | |
| TW | M407938 | U | 7/2011 | |
| TW | M487337 | U | 10/2014 | |
| TW | M561706 | U | 6/2018 | |

* cited by examiner

AUTO-ASSEMBLED-AND-FOLDED SUPPORT FRAME

BACKGROUND OF THE INVENTION

1. Field of the Invention

The present invention relates to a support frame, especially to a supporting frame that is used in construction and can be automatically assembled and folded.

2. Description of Related Art

In construction nowadays, for high-floor constructing and building, scaffolding is assembled for workers to climb up and down. Most of the scaffolding of lower-level floors, such as floors under the third floor, is assembled manually. Lower-level floors scaffolding is assembled firstly by composing a frame, which is made by assembling multiple rods to four posts, then mounting platforms onto the frame, and so on to build to a preset height. While assembling the scaffolding, workers must transfer components of the scaffolding upward to assemble, then get down to retrieve more components, repeating the aforementioned movements again and again until the scaffolding building is finished.

However, in the process of stacking the scaffolding, the workers have to climb up and down, thus consuming lots of energy and time. Furthermore, climbing while carrying things is dangerous, especially when assembling the frame at higher levels and without security fences. Besides, for convenience, the workers may neglect wearing safety aids when the height they are at is not so great, causing larger risk of a work accident. Therefore, there is need of improvement.

SUMMARY OF THE INVENTION

In view of shortcomings of the prior arts, the present invention provides an auto-assembled-and-folded support frame that can be assembled and folded automatically. The support frame can be quickly expanded or folded by its multiple straight rod assemblies, and multiple linkage assemblies are connected to be expandable and foldable. The present invention can increase safety for assembling and dismantling of scaffolding.

The support frame comprises the multiple straight rod assemblies and the multiple linkage assemblies. The multiple straight rod assemblies are arranged at intervals in a rectangular shape. Each one of the multiple linkage assemblies is connected between two of the multiple straight rod assemblies and comprises at least one first upper rod, a second upper rod, a joint seat, a first lower rod, at least one second lower rod, and a connecting seat. The at least one first upper rod and the second upper rod each have a bottom end pivotally connected to the joint seat. A top end of the at least one first upper rod is pivotally connected to one of the two corresponding straight rod assemblies. A top end of the second upper rod is pivotally connected to the other one of the two corresponding straight rod assemblies. The first lower rod and the at least one second lower rod each have a top end pivotally connected to the connecting seat. A bottom end of the first lower rod is pivotally connected to one of the two corresponding straight rod assemblies. A bottom end of the at least one second lower rod is pivotally connected to the other one of the two corresponding straight rod assemblies. The connecting seat is disposed on top of the joint seat. The connecting seat and the joint seat are attached to or detached from each other selectively. When the support frame is in an expanded state, the joint seat and the connecting seat of each one of the multiple linkage assemblies are attached to each other. When the support frame is in a folded state, the joint seat and the connecting seat of each one of the multiple linkage assemblies are detached from each other. A distance between each of the multiple straight rod assemblies when the support frame is in the expanded state is longer than a distance between each of the multiple straight rod assemblies when the support frame is in the folded state.

Furthermore, the support frame comprises a pressure ring assembly comprising a ring body and multiple support rods. Each one of the multiple support rods has an inner end pivotably connected to the ring body and an outer end pivotably connected to one of the multiple straight rod assemblies. A connecting position of said support rod and said straight rod assembly is disposed between two connecting positions. Among them, one of the two connecting positions is between the at least one first upper rod and said straight rod assembly, and the other one of the two connecting positions is between the first lower rod and said straight rod assembly. Or, one of the two connecting positions is between the second upper rod and said straight rod assembly, and the other one of the two connecting positions is between the at least one second lower rod and said straight rod assembly.

Advantages of the support frame are that the support frame has the expanded state and the folded state. Therefore, the support frame can be folded for easy transportation and saving space, and can be expanded quickly for stacking scaffolding. Further, by moving the ring body, the support frame can be expanded simply and fast for stacking scaffolding. Besides, when stacking scaffolding with multiple support frames, the support frames can be automatically assembled by using a base rack set and at least one robotic arm, thereby significantly reducing labor costs and building time, hence increasing work safety.

DETAILED DESCRIPTION OF THE PREFERRED EMBODIMENT

With reference to drawings and preferable embodiments in accordance with the present invention, descriptions below are to elaborate technical means to achieve the intended purpose of the present invention.

Figure 1:
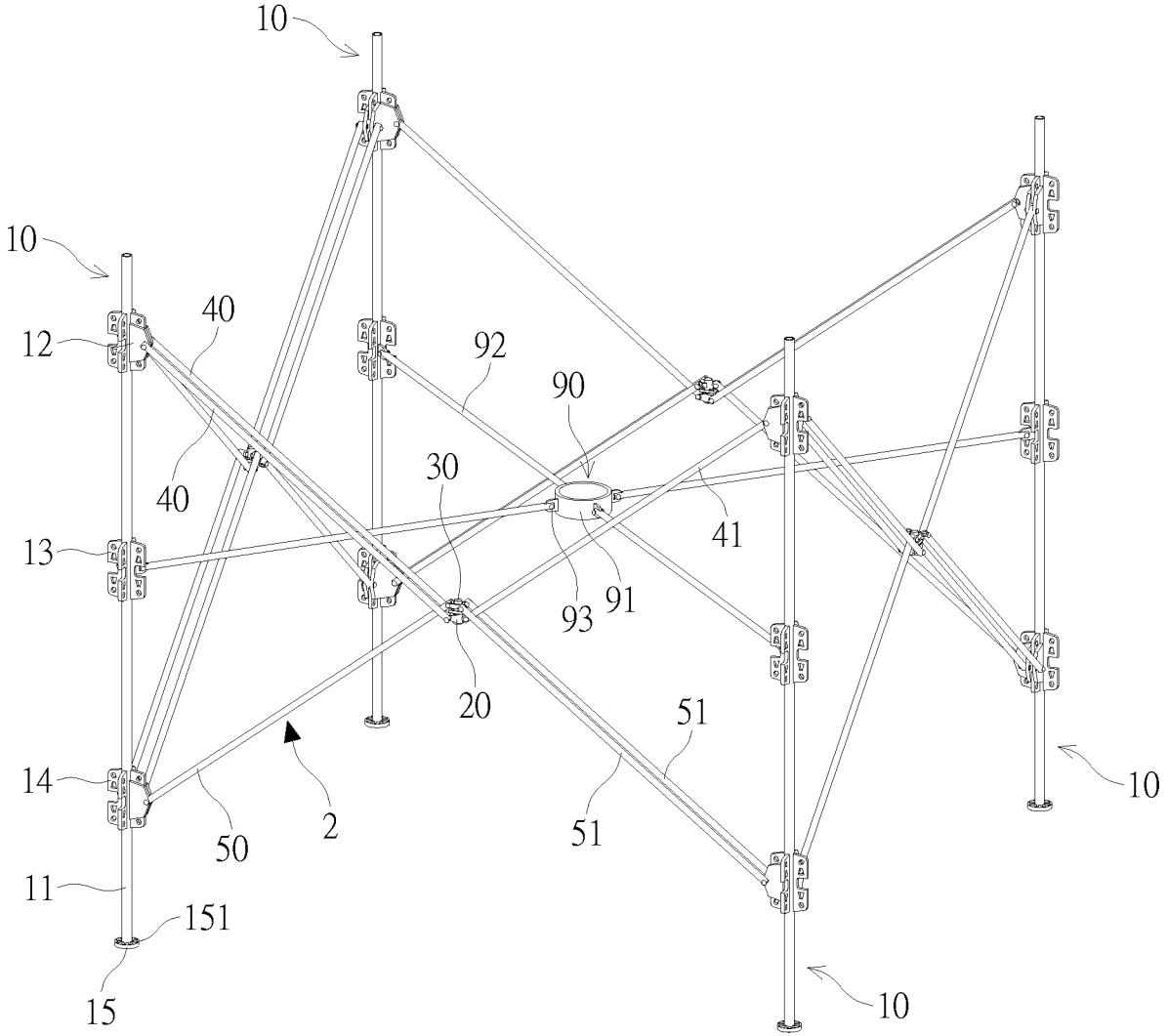
FIG. 1 is a perspective view of a support frame that can be assembled and folded automatically in accordance with the present invention in an expanded state.
Figure 2:
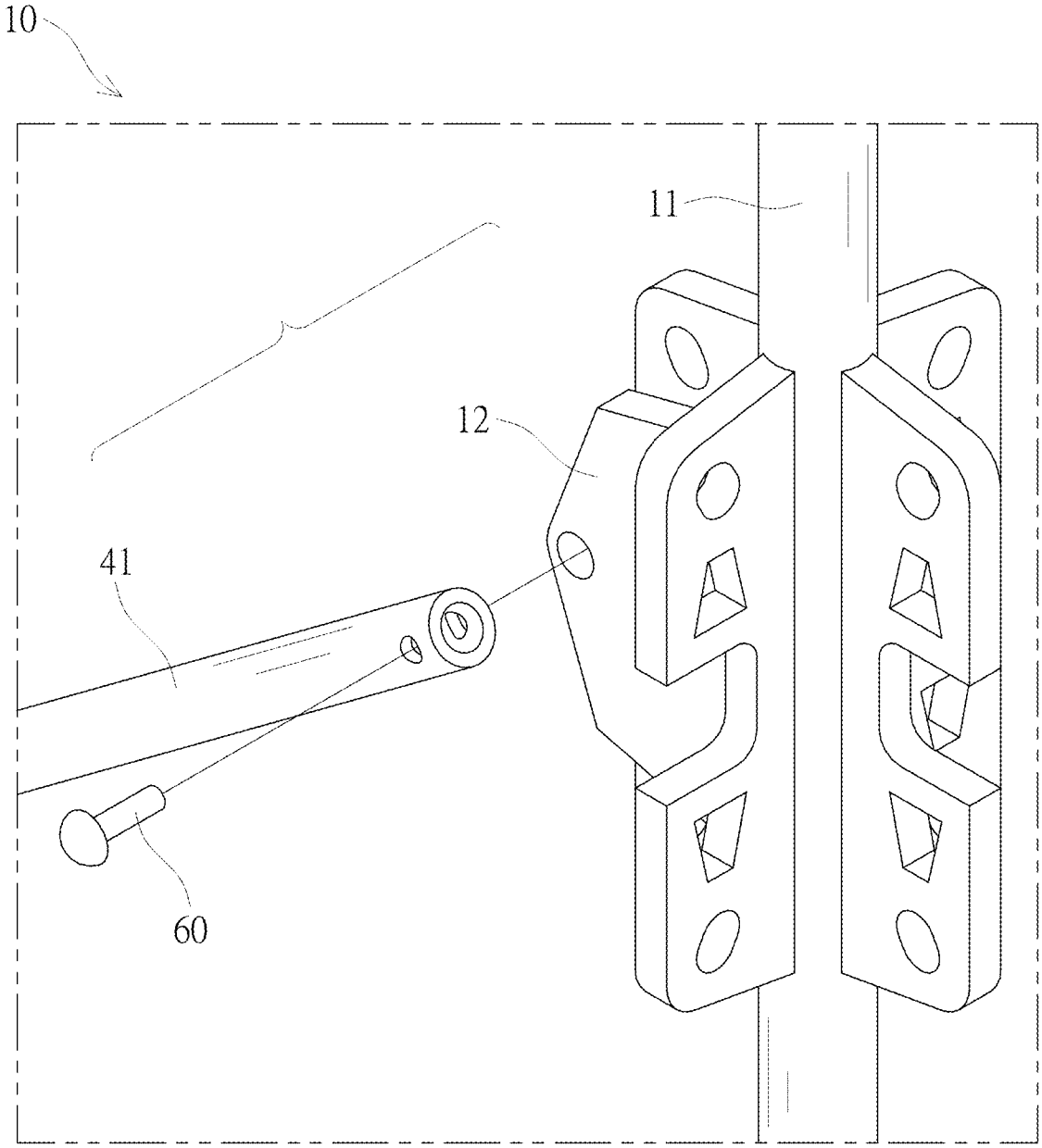
FIG. 2 is a partially-enlarged exploded view of a straight rod assembly of the support frame in accordance with the present invention.

With reference to FIG. 1, a support frame that can be assembled and folded automatically in accordance with the present invention comprises multiple straight rod assemblies 10, multiple linkage assemblies 2 and a pressure ring assembly 90.

With reference to FIGS. 1, 2, 11 and 14, in this embodiment, the support frame has four straight rod assemblies 10 arranged at intervals in a rectangular shape. One of the multiple linkage assemblies 2 is disposed between two of the four straight rod assemblies 10, which are disposed at a same side of the support frame. Each one of the multiple linkage assemblies 2 comprises at least one first upper rod 40, a second upper rod 41, a joint seat 20, a first lower rod 50, at least one second lower rod 51, and a connecting seat 30. In this embodiment, each one of the multiple straight rod assemblies 10 comprises a vertical post 11, multiple upper contact seats 12, multiple middle contact seats 13, and multiple lower contact seats 14. The vertical post 11 has a support disc 15 mounted at a bottom end of the vertical post 11. The support disc 15 has multiple engagement holes 151 penetrating through the support disc 15, arranged around a center of the support disc 15, and spaced apart from each other. Each one of the multiple upper contact seats 12 is a plate and has at least one upper pivotally-connecting hole 121 penetrating through said upper contact seat 12. One end of each one of the multiple upper contact seats 12 is mounted at the vertical post 11 and is near a top end of the vertical post 11. The multiple upper contact seats 12 are arranged around an axial center of the vertical post 11 and are spaced apart from each other. Each one of the multiple middle contact seats 13 is a plate and has at least one middle fixation hole 131 penetrating through said middle contact seat 13. The multiple middle contact seats 13 are arranged around the axial center of the vertical post 11 and are spaced apart from each other. Each one of the multiple lower contact seats 14 is a plate and has at least one lower pivotally-connecting hole 141 penetrating through said lower contact seat 14. The multiple lower contact seats 14 are arranged around the axial center of the vertical post 11 and are spaced apart from each other. However, configurations of the multiple straight rod assemblies 10 are not limited to that and can be altered according to user's needs.

Figure 3:
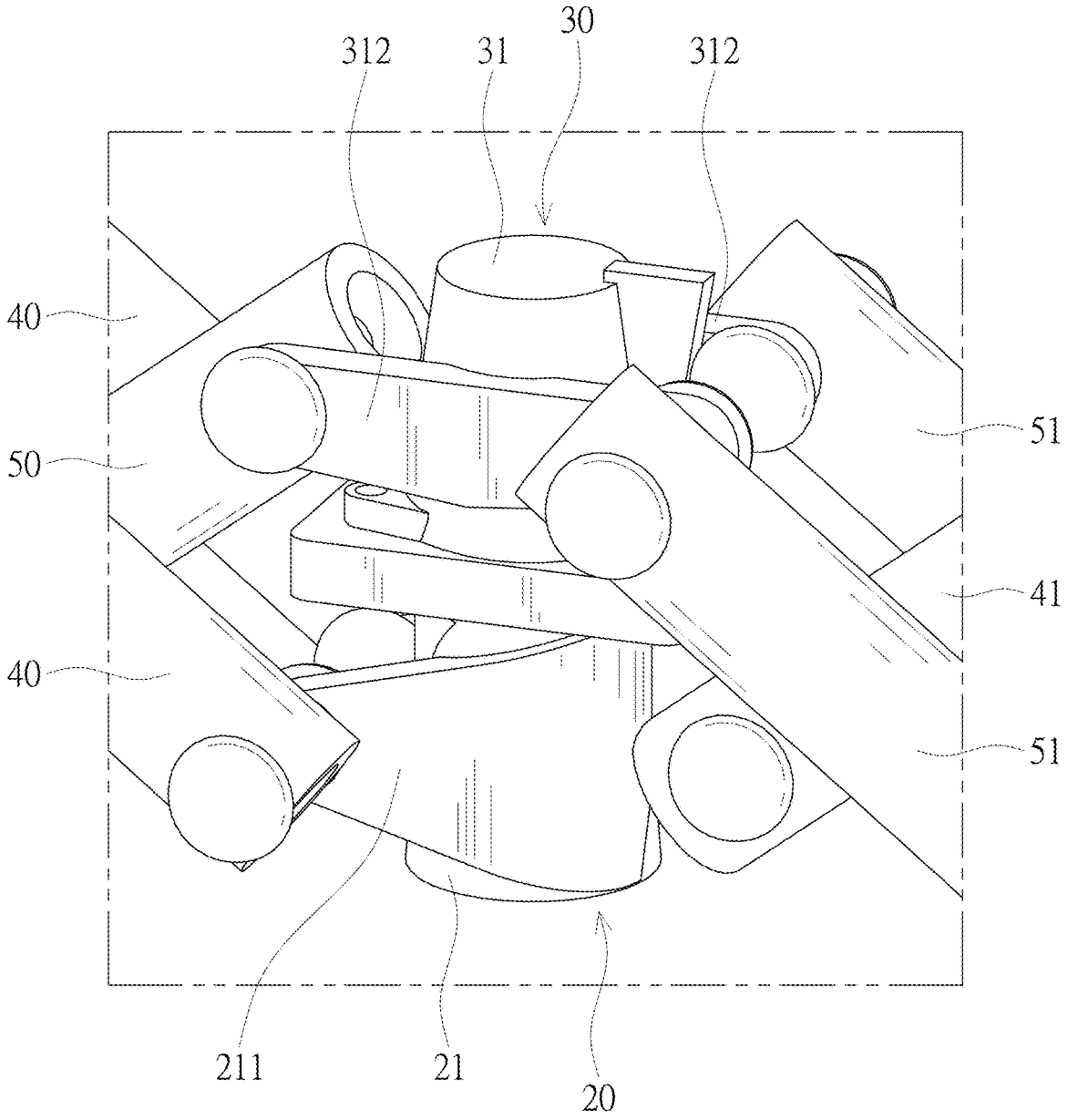
FIG. 3 is a partially-enlarged perspective view of the support frame in accordance with the present invention.
Figure 4:
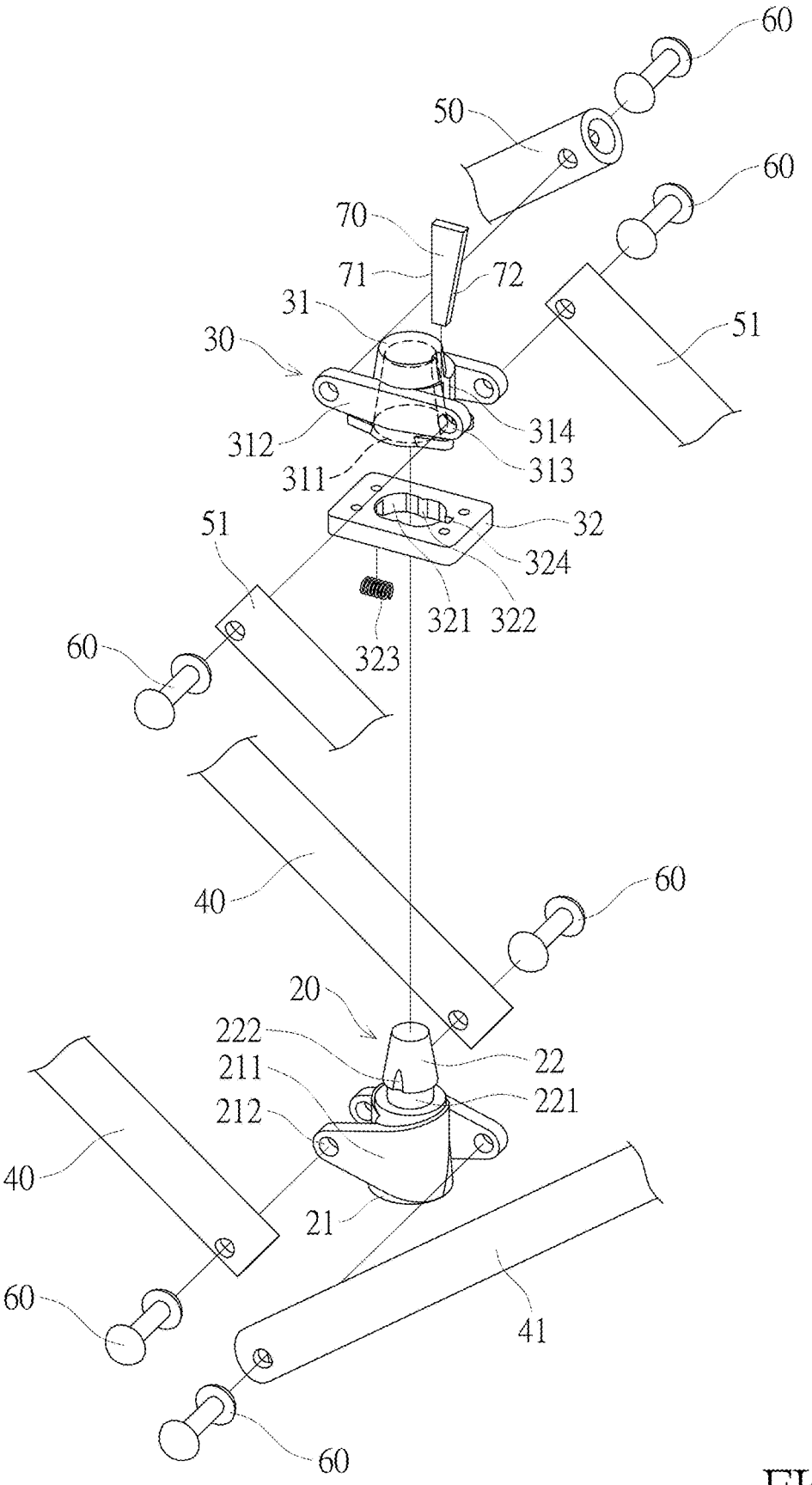
FIG. 4 is a partially exploded view of elements related to a joint seat and a connecting seat of the support frame in accordance with the present invention.

With reference to FIGS. 1, 3 and 4, for conciseness in description, the following descriptions take two of the multiple straight rod assemblies 10 and one of the multiple linkage assemblies 2 that are disposed at the same side of the support frame as an example. The joint seat 20 comprises an upper pivotally-connecting portion 21 and a tenon 22. The upper pivotally-connecting portion 21 is columnar and has a front-side surface, a rear-side surface, and two lateral-side surfaces, which are disposed between the front-side surface and the rear-side surface. The upper pivotally-connecting portion 21 has two upper pivotally-connecting pieces 211 respectively and laterally protruding from the front-side surface and the rear-side surface of the upper pivotally-connecting portion 21. Each one of the two upper pivotally-connecting pieces 211 has an upper contact hole 212 penetrating through said upper pivotally-connecting piece 211. The tenon 22 protrudes from an end of the upper pivotally-connecting portion 21 and has a clip recess 221 surrounding an outer wall of the tenon 22 and disposed at an end of the tenon 22 that is near the upper pivotally-connecting portion 21. The tenon 22 has at least one alignment recess 222 in the outer wall of the tenon 22 and extending vertically. In this embodiment, a number of the at least one alignment recess 222 is multiple, and the multiple alignment recesses 222 extend coaxially along the upper pivotally-connecting portion 21 and are arranged opposite to each other.

With reference to FIGS. 1, 3 and 4 to 8, the connecting seat 30 comprises a lower pivotally-connecting portion 31 and a lock plate 32. The lower pivotally-connecting portion 31 is columnar and has a contact recess 311 depressed to form an end of the lower pivotally-connecting portion 31. A shape of the contact recess 311 corresponds to a shape of the tenon 22. The lower pivotally-connecting portion 31 has a front-side surface, a rear-side surface, and two lateral-side surfaces, which are disposed between the front-side surface and the rear-side surface of the lower pivotally-connecting portion 31. The lower pivotally-connecting portion 31 has two lower pivotally-connecting pieces 312 respectively and laterally protruding from the front-side surface and the rear-side surface of the lower pivotally-connecting portion 31. Each one of the two lower pivotally-connecting pieces 312 has a lower contact hole 313 penetrating through said lower pivotally-connecting piece 312. The connecting seat 30 has a guide recess 314 depressed between the two lower pivotally-connecting pieces 312 and extending vertically on the connecting seat 30 and coaxially along the lower pivotally-connecting portion 31. The connecting seat 30 is not limited to that configuration and may have no guide recess 314. The lock plate 32 has a limiting hole 321 penetrating through it. The lock plate 32 has at least one protrusion rib 322 extending from a contour of the limiting hole 321. In this embodiment, the lock plate 32 has two protrusion ribs 322 disposed at two opposite sides of the contour of the limiting hole 321 and corresponding to the alignment recess 222 in position. The lock plate 32 has an elastic element 323 mounted at a side of the contour of the limiting hole 321. In this embodiment, the elastic element 323 is a compression spring. At another side, which is opposite to the elastic element 323, of the contour of the limiting hole 321, a slot 324 is in the contour of the limiting hole 321 and communicates with the guide recess 314. Configurations of the elastic element 323 and whether to have the slot 324 can be altered according to user's needs. The lock plate 32 is mounted at the lower pivotally-connecting portion 31 and is near an opening of the contact recess 311. The tenon 22 can pass through the limiting hole 321 to extend into the contact recess 311. Pushed by the elastic element 323, the tenon 22 can be moved along the limiting hole 321 relative to the connecting seat 30 until an end of the contour of the limiting hole 321 contacts the clip recess 221 of the tenon 22. The joint seat 20 is disposed below the connecting seat 30. Structures of the joint seat 20 and structures of the connecting seat 30 can be exchanged, which means the tenon 22 can be formed at the connecting seat 30 and the contact recess 311 can be formed at the joint seat 20.

In this embodiment, two first upper rods 40 and two second lower rods 51 are inclined. The two first upper rods 40 are parallel and the two second lower rods 51 are parallel. Bottom ends of the two first upper rods 40 and a bottom end of the second upper rod 41 are pivotably mounted at the joint seat 20 through pins 60, which are pivotably mounted at the upper contact holes 212 of the two upper pivotally-connecting pieces 211 of the joint seat 20. Top ends of the two first upper rods 40 are pivotably mounted at one of the two straight rod assemblies 10, which are disposed at the same side of the support frame, and specifically mounted at the upper pivotally-connecting hole 121 of the upper contact seat 12. A top end of the second upper rod 41 is pivotably mounted at the other one of the two straight rod assemblies 10, and specifically mounted at the upper pivotally-connecting hole 121 of the upper contact seat 12. A top end of the first lower rod 50 and top ends of the two second lower rods 51 are pivotably mounted at the connecting seat 30, specifically are pivotably mounted at the lower contact holes 313 of the two lower pivotally-connecting pieces 312 of the connecting seat 30 through other pins 60. A bottom end of the first lower rod 50 is pivotably mounted at one, which is the same one that the two first upper rods 40 are connected to, of the two straight rod assemblies 10, and specifically is pivotably mounted at the lower pivotally-connecting hole 141 of the lower contact seat 14. Bottom ends of the two second lower rods 51 are pivotably mounted at the other one of the two straight rod assemblies 10, and specifically are pivotably mounted at the lower pivotally-connecting hole 141 of the lower contact seat 14. The first lower rod 50 is disposed between the two first upper rods 40. The second upper rod 41 is disposed between the two second lower rods 51. By this two-rods configuration, structural stability is enhanced to avoid torsion.

Figure 9:
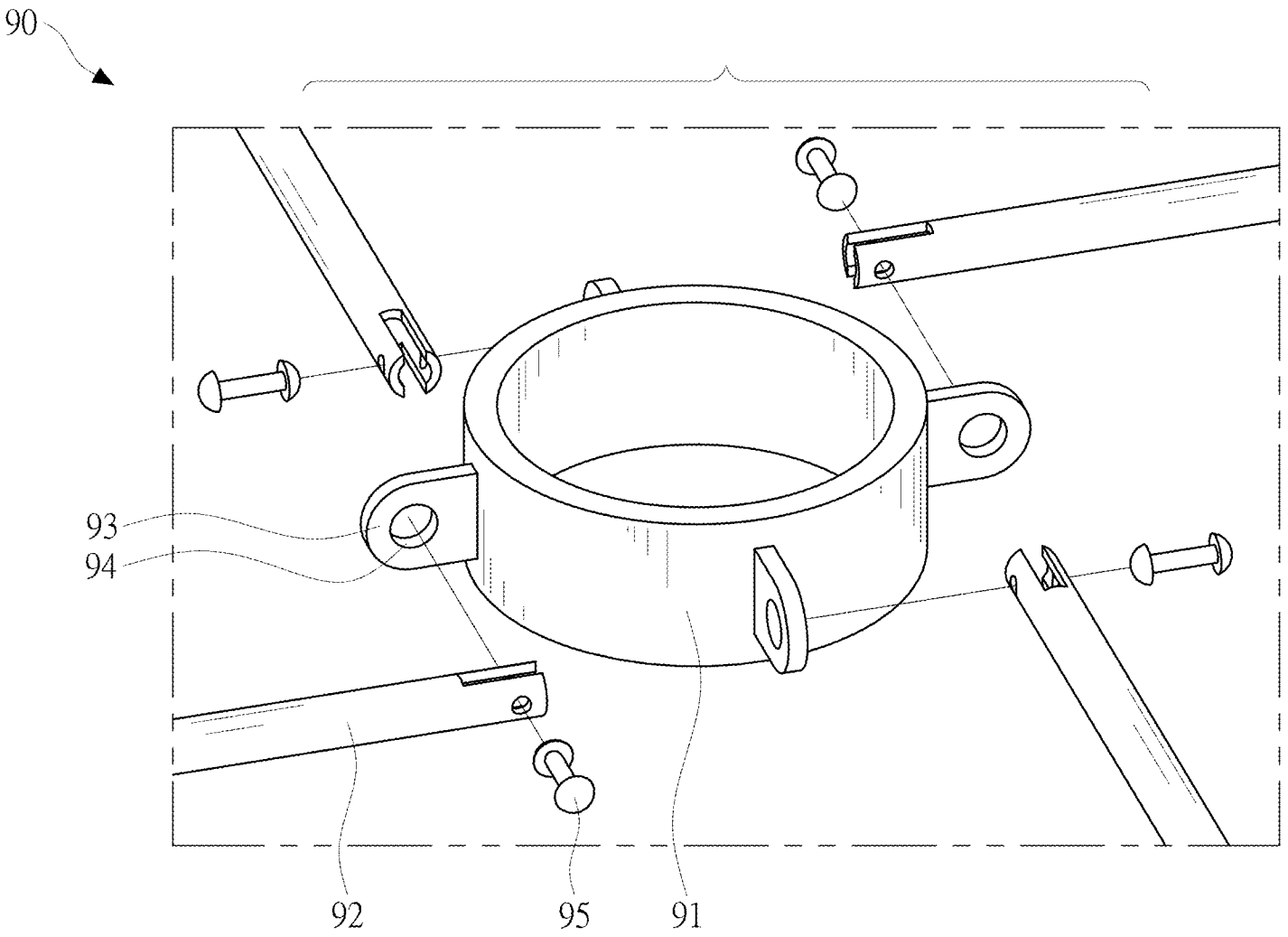
FIG. 9 is a partially-enlarged exploded view of a pressure ring assembly of the support frame in accordance with the present invention.
Figure 10:
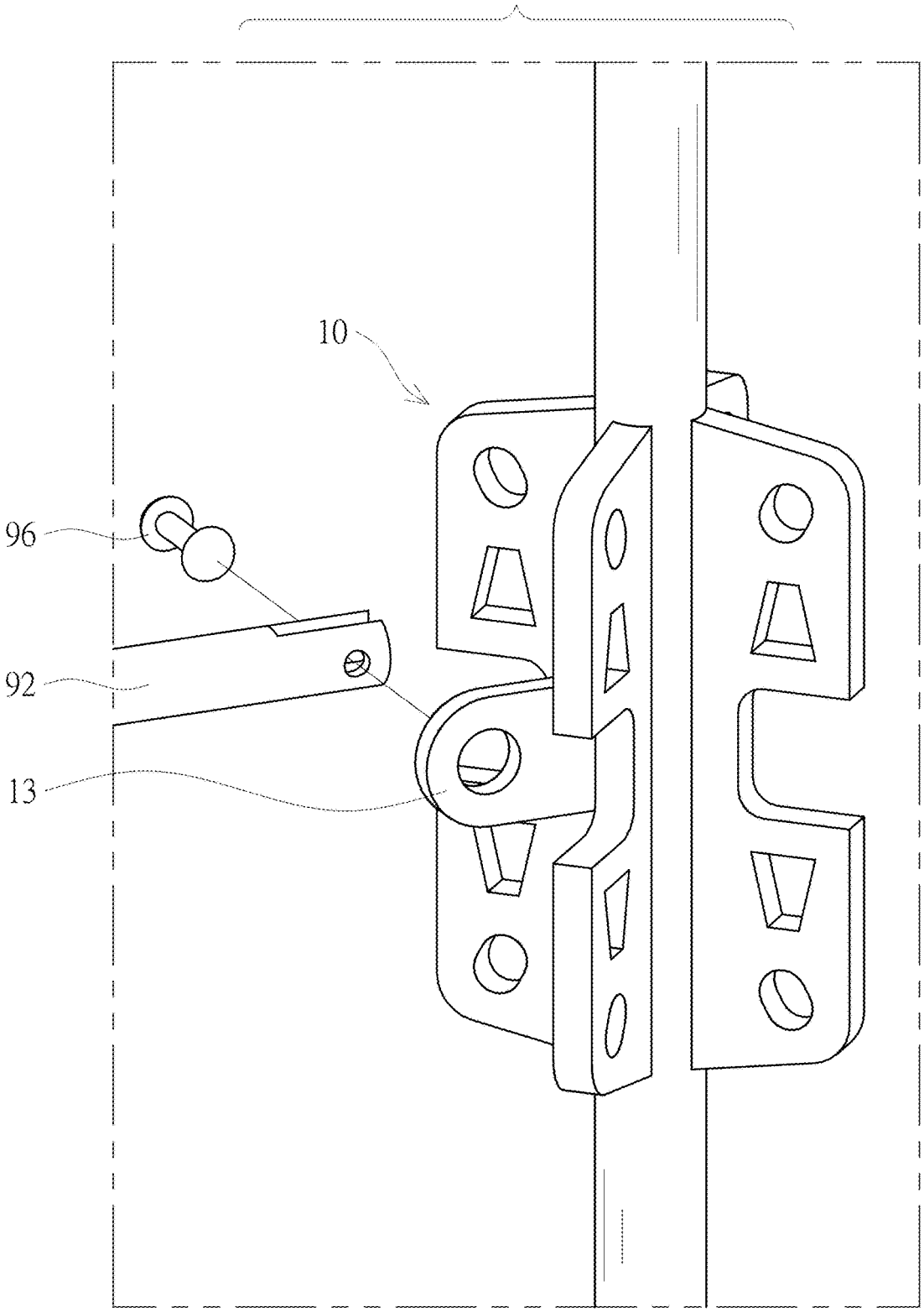
FIG. 10 is a partially-enlarged exploded view of a support rod of the support frame in accordance with the present invention, mounted to the straight rod assembly.

With reference to FIGS. 1, 9 and 10, the pressure ring assembly 90 comprises a ring body 91 and multiple support rods 92. The ring body 91 has an outer surrounding surface and multiple connecting portions 93 protruding from the outer surrounding surface. In this embodiment, a number of the multiple connecting portions 93 is four, but it is not limited to that. Each one of the multiple connecting portions 93 has a through hole 94 penetrating through it. An inner end of each one of the multiple support rods 92 is pivotably mounted at one of the multiple connecting portions 93 by a first pivotable bolt 95 passing through the through hole 94 of said connecting portion and said support rod 92. An outer end of each one of the multiple support rods 92 is pivotably mounted at the middle contact seat 13 of one of the multiple straight rod assemblies 10 through a second pivotable bolt 96. Pivotable connecting is a common technique, and therefore is not to be further elaborated.

Each one of the multiple straight rod assemblies 10 has an upper portion, a lower portion and a supporting portion. The upper portion (upper contact seat 12) is connected to the at least one first upper rod 40 or the second upper rod 41. The lower portion (lower contact seat 14) is connected to the first lower rod 50 or the at least one second lower rod 51. The supporting portion (middle contact seat 13) is connected to one of the support rods 92, and the supporting portion is disposed between the upper portion and the lower portion.

Figure 6:
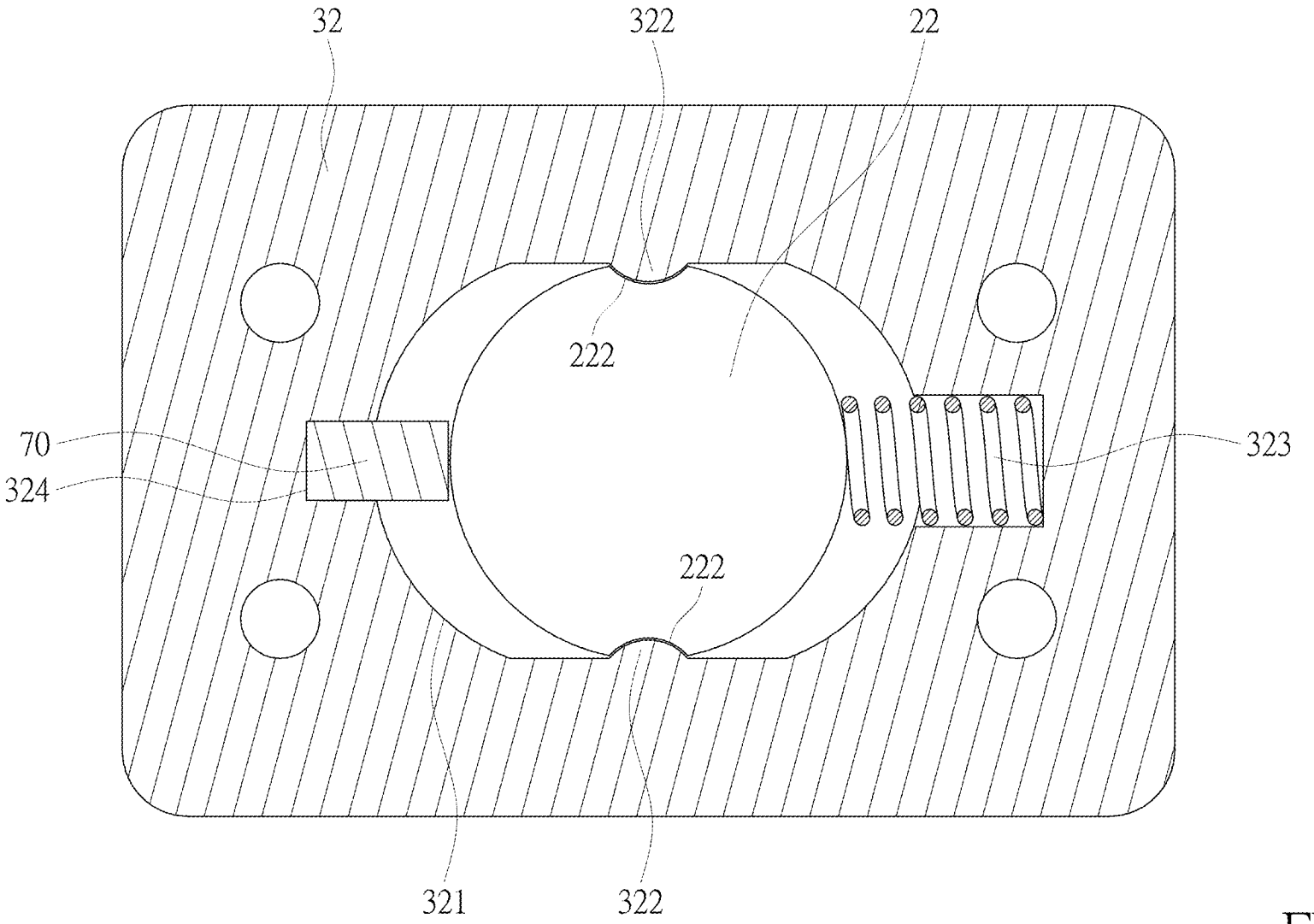
FIG. 6 is a partial sectional view of the joint seat and the connecting seat, being attached and in a locked-in-place state, of the support frame in accordance with the present invention.
Figure 7:
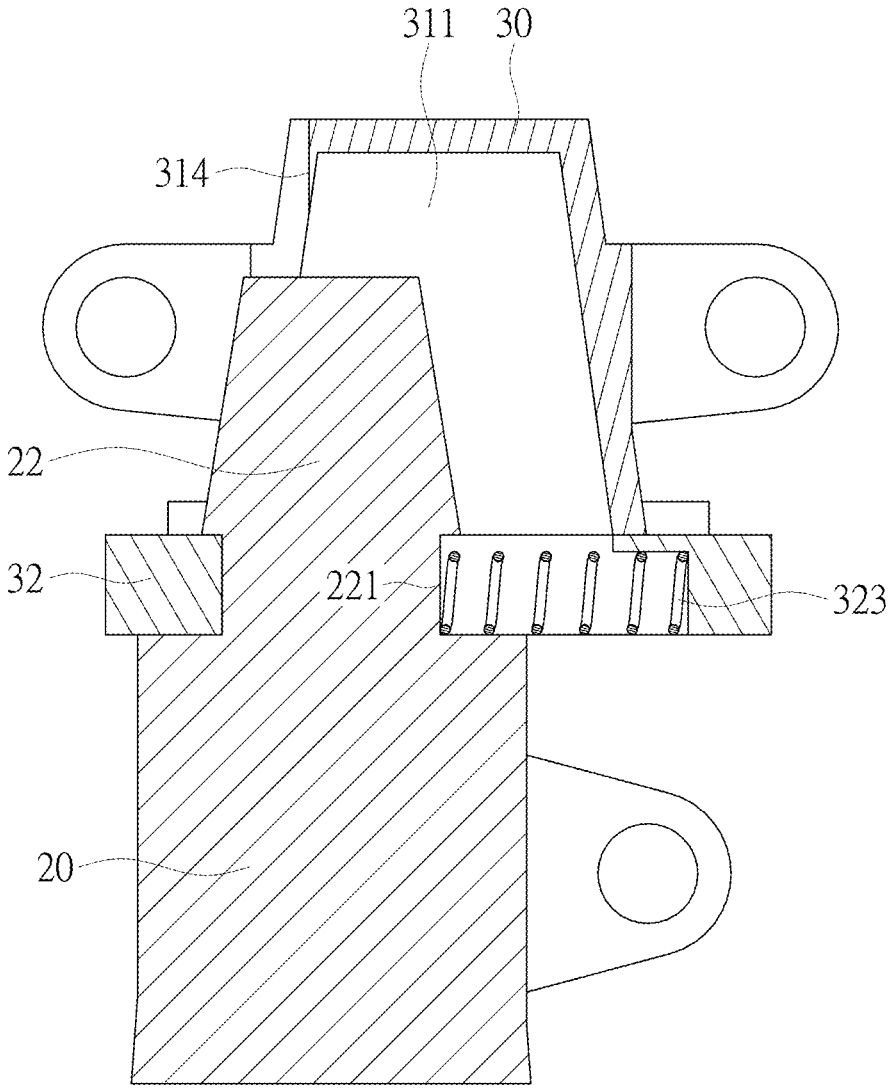
FIG. 7 is a partial sectional view of the joint seat and the connecting seat of the support frame in accordance with the present invention, when a plug does not engage.
Figure 11:
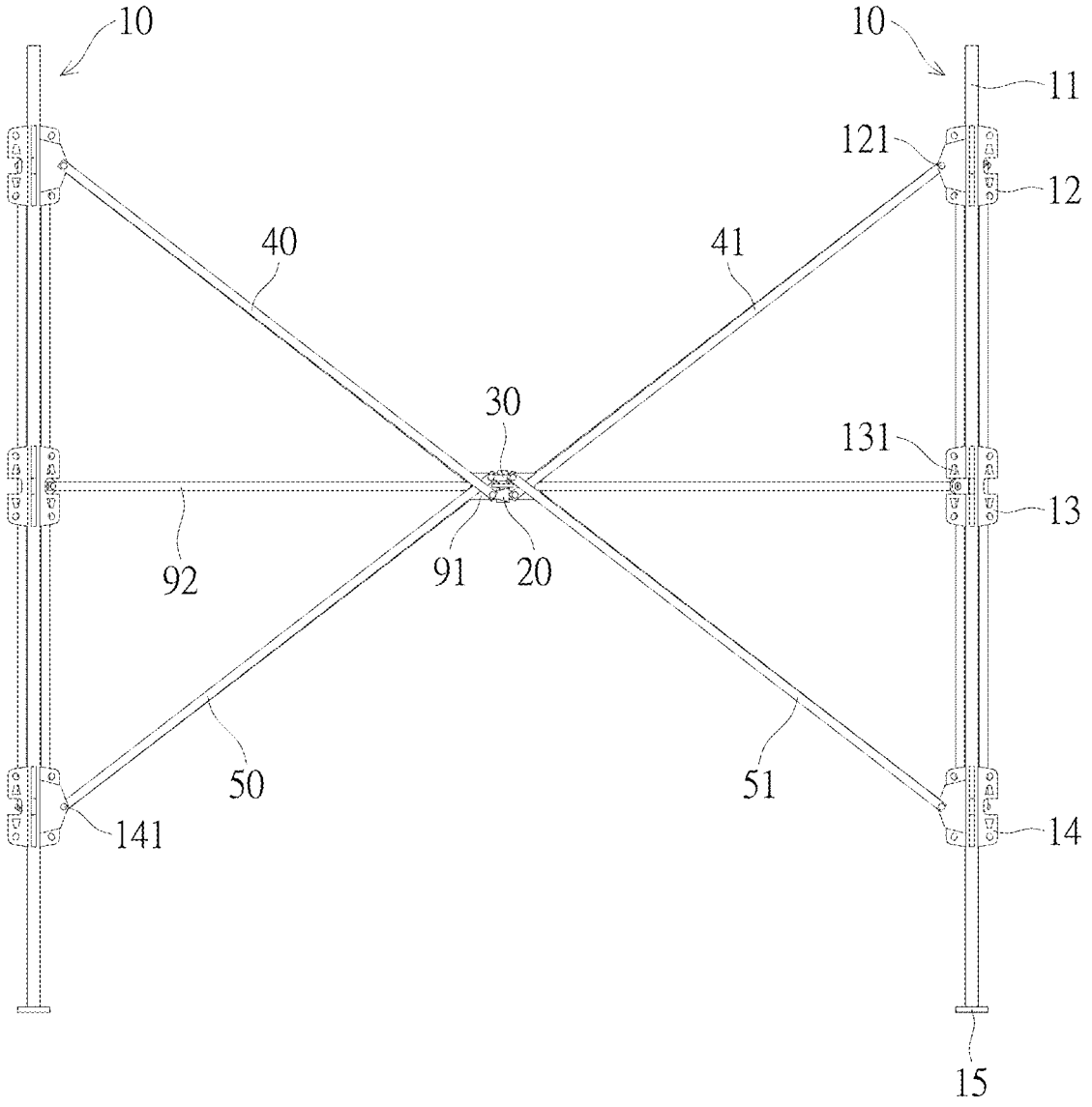
FIG. 11 is a side view of the support frame in accordance with the present invention, shown expanded.

The support frame can be in an expanded state or a folded state. With reference to FIGS. 1 and 11, when the support frame is in the expanded state, any two of the multiple straight rod assemblies 10 keep a distance between them. The at least one first upper rod 40 and the second lower rod 51 are disposed at the same side of the support frame are parallel. The at least one first lower rod 50 and the second upper rod 41 disposed at the same side of the support frame are parallel. Therefore, the upper rods 40, 41 and the lower rods 50, 51 compose an X-shaped structure. The ring body 91 of the pressure ring assembly 90 is approximately disposed at a central position of the support frame, and the multiple support rods 92 are horizontal, so the pressure ring assembly 90 can stably support and unfold the multiple straight rod assemblies 10, enhancing structural rigidity. With reference to FIGS. 4, 6 and 7, the tenon 22 passes through the limiting hole 321 and extends into the contact recess 311. By the elastic element 323 pushing the tenon 22, the clip recess 221 of the tenon 22 is moved in the lock plate 32 until contacting an end of the limiting hole 321 to engage with the lock plate 32. By the clip recess 221 engaged with the lock plate 32 to fix it in place, the joint seat 20 and the connecting seat 30 are attached and fixed together to be in a locked-in-place state.

Figure 5:
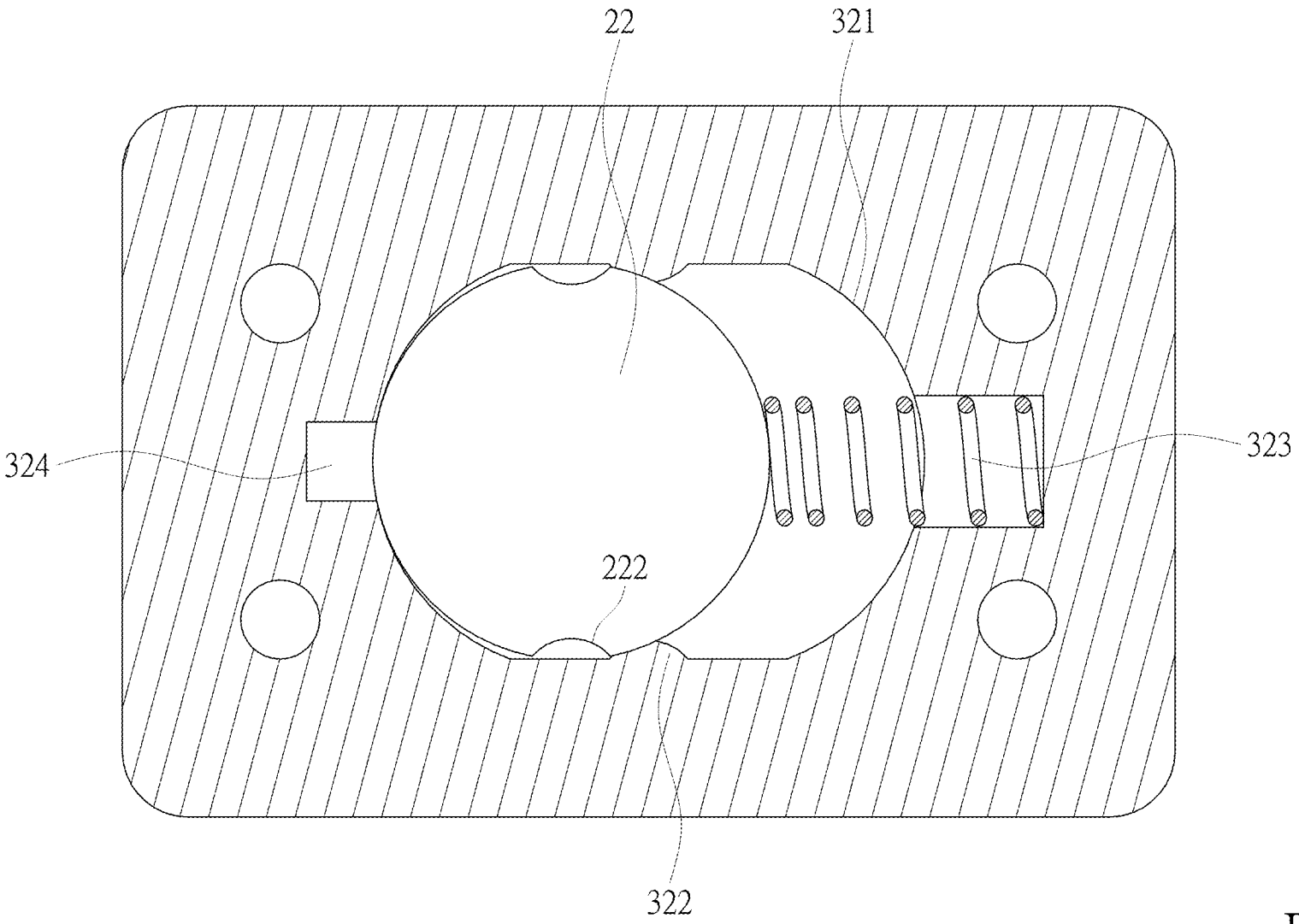
FIG. 5 is a partial sectional view of the joint seat and the connecting seat, being detachable, of the support frame in accordance with the present invention.
Figure 8:
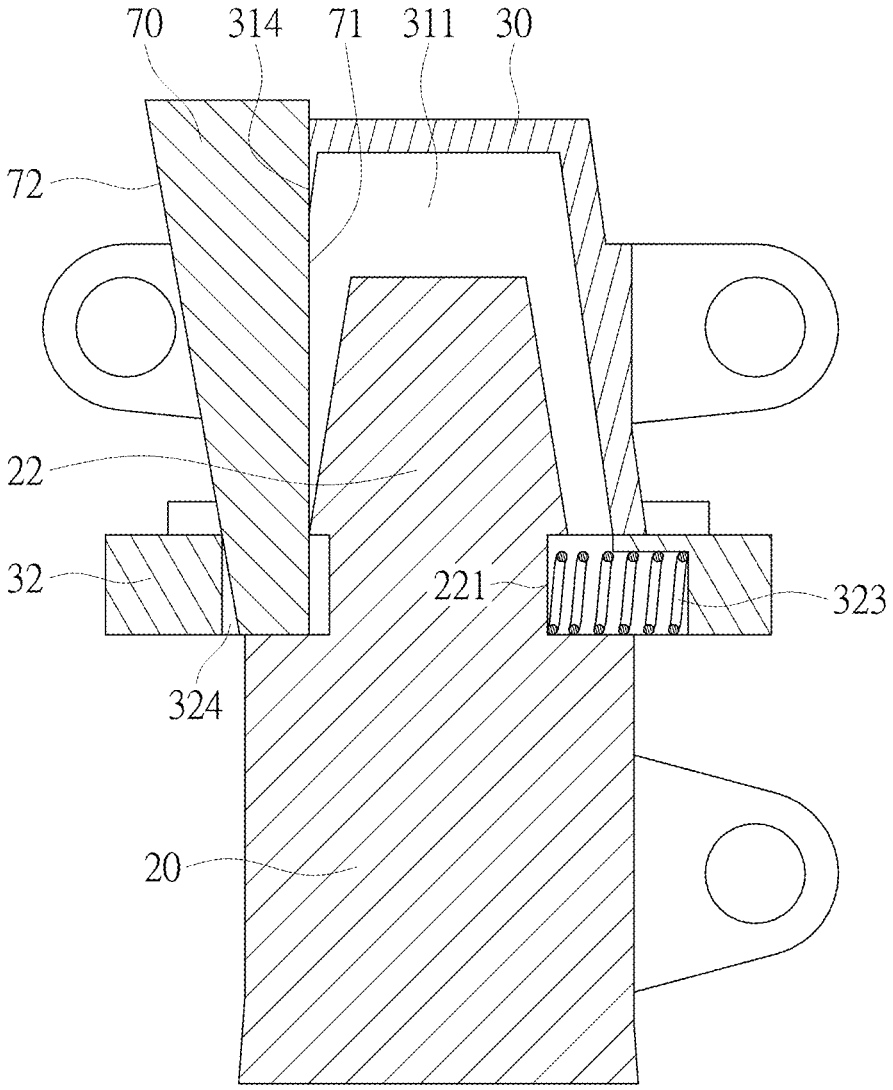
FIG. 8 is a partial sectional view of the joint seat and the connecting seat of the support frame in accordance with the present invention, when the plug is engaged.
Figure 12:
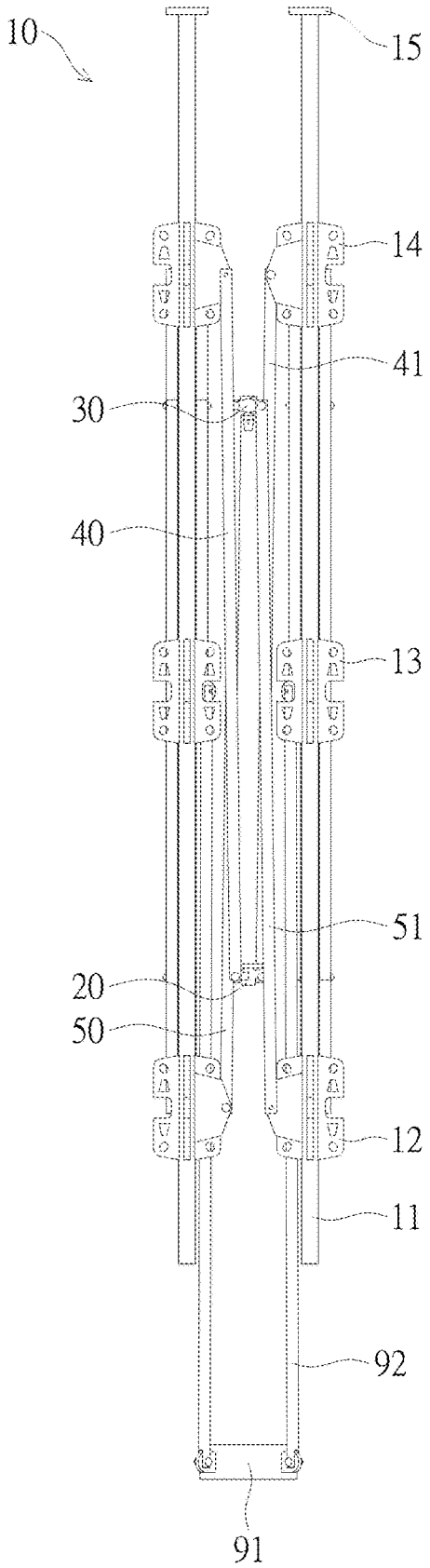
FIG. 12 is a side view of the support frame in accordance with the present invention, shown folded.

With reference to FIGS. 4, 5 and 8, the support frame can change its configuration from the expanded state to the folded state through using a plug 70. The plug 70 has a vertical edge 71 and an inclined edge 72 disposed opposite to each other. The inclined edge 72 contacts the lock plate 32. The plug 70 is inserted into the slot 324 along the guide recess 314 to move the joint seat 20 toward the elastic element 323, so the joint seat 20 compresses the elastic element 323 until the at least one protrusion rib 322 aligns with the at least one alignment recess 222. Therefore, the joint seat 20 and the connecting seat 30 are detachable, and can be respectively moved away from each other vertically to be detached. In other words, the plug 70 works as a security mechanism. Only when the user is operating the plug 70 deliberately, can the support frame be folded. Without operating the plug 70, the support frame maintains the expanded state and cannot be folded. A distance between the multiple straight rod assemblies 10 when the support frame is in the expanded state is longer than a distance between the multiple straight rod assemblies 10 when the support frame is in the folded state. With reference to FIG. 12, while the joint seat 20 and the connecting seat 30 are moved away from each other and in process of detachment, the at least one first upper rod 40, the second upper rod 41, the first lower rod 50, the at least one second lower rod 51, and the multiple support rods 92 are pivoted at the same time, so the multiple straight rod assemblies 10 are all moved toward each other. The ring body 91 is moved downward until the multiple straight rod assemblies 10 and the multiple support rods 92 are near each other and the support frame is at the folded state. Therefore, the support frame is folded for easy transportation and saving space. By moving the ring body 91, the support frame and the multiple straight rod assemblies 10 can be expanded quickly for stacking scaffolding. To change the support frame from the folded state to the expanded state, simply push the ring body 91 upward, and the multiple support rods 92 will simultaneously push the multiple straight rod assemblies 10 outwardly. To change the support frame from the expanded state to the folded state, simply pushing the ring body 91 downward can achieve it.

Figures 13, 14:
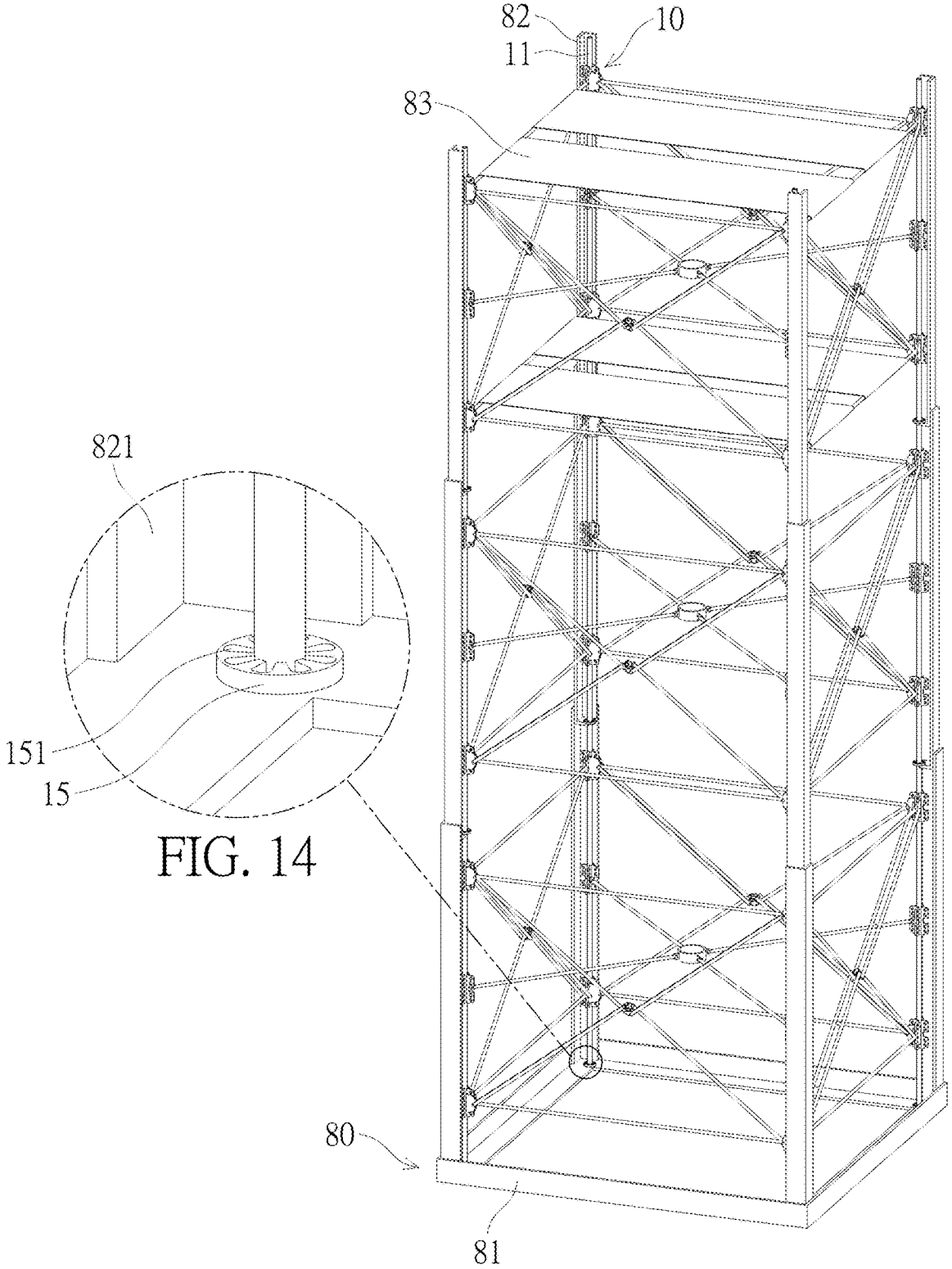
FIG. 13 is a perspective view of the support frame in accordance with the present invention, used to build scaffolding.
FIG. 14 is a partially-enlarged view of FIG. 13.

With reference to FIGS. 11, 13 and 14, when stacking scaffolding with multiple support frames, a base rack set 80 and at least one robotic arm can be used for stacking with appropriate human assistance. The base rack set 80 comprises a base surrounding frame 81 and multiple extendable racks 82. The surrounding frame is rectangular. Each one of the multiple extendable racks 82 mounted at one of four corners of the base surrounding frame 81 can extend upwardly, and has multiple segments. The segment of the extendable rack 82 has a support portion 821 near a bottom end of the segment and having multiple engaging elements that engage with the engagement holes 151 of the support disc 15 of the vertical post 11. The robotic arm is mounted near the base rack set 80. The robotic arm expands the first one of the multiple support frames from the folded state to the expanded state and puts the first support frame on the base rack set 80. Each one of the multiple straight rod assemblies 10 is disposed inside one of the multiple extendable racks 82. The multiple engagement holes 151 of the support disc 15 are engaged with the support portion 821. Multiple horizontal racks are mounted on the lower contact seats 14 of different straight rod assemblies 10 and are stacked on the upper contact seats 12 of different straight rod assemblies 10. Multiple platform boards are placed on the multiple horizontal racks. According to user's needs, the horizontal racks can be mounted on the at least one middle fixation hole 131 of the middle contact seats 13 of two of the multiple straight rod assemblies 10 that are at the same side of said support frame. When completing assembling the first support frame, the first segments of the multiple extendable racks 82 are lifted simultaneously. Then the robotic arm expands and puts the second support frame between the second segments of the multiple extendable racks 82 to be assembled with aforementioned process, and so on. The multiple straight rod assemblies 10 of one of the support frames are respectively engaged with the multiple straight rod assemblies 10 of another one of the support frames that is on top of them, which is a common technique and hence will not be further elaborated. Therefore, the support frames can be automatically assembled. During building construction, the robotic arm and operators can complete assembling on the ground without climbing up and down to proceed stacking, thereby significantly reducing risks and improving work safety. Besides, minimal manpower and fast building of scaffolding can reduce labor costs.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An auto-assembled-and-folded support frame comprising:

multiple straight rod assemblies arranged at intervals in a rectangular shape;

multiple linkage assemblies, each one of the multiple linkage assemblies connected between two of the multiple straight rod assemblies and comprising at least one first upper rod;

a second upper rod;

a joint seat;

a first lower rod;

at least one second lower rod;

a connecting seat;

the at least one first upper rod and the second upper rod each having a bottom end pivotally connected to the joint seat; the at least one first upper rod having a top end pivotally connected to one of the two corresponding straight rod assemblies; the second upper rod having a top end pivotally connected to the other one of the two corresponding straight rod assemblies;

the first lower rod and the at least one second lower rod each having a top end pivotally connected to the connecting seat; the first lower rod having a bottom end pivotally connected to one of the two corresponding straight rod assemblies; the at least one second lower rod having a bottom end pivotally connected to the other one of the two corresponding straight rod assemblies;

the connecting seat disposed on top of the joint seat, and the connecting seat and the joint seat attached to or detached from each other selectively;

wherein when the auto-assembled-and-folded support frame is in an expanded state, the joint seat and the connecting seat of each one of the multiple linkage assemblies are attached to each other;

wherein when the auto-assembled-and-folded support frame is in a folded state, the joint seat and the connecting seat of each one of the multiple linkage assemblies are detached from each other;

wherein a distance between each of the multiple straight rod assemblies when the auto-assembled-and-folded support frame is in the expanded state is longer than a distance between each of the multiple straight rod assemblies when the auto-assembled-and-folded support frame is in the folded state.

2. The auto-assembled-and-folded support frame as claimed in claim 1, wherein in each one of the multiple linkage assemblies, a number of the at least one second lower rod is two, the second upper rod is disposed between the two second lower rods.

3. The auto-assembled-and-folded support frame as claimed in claim 2, wherein in each one of the multiple linkage assemblies, the connecting seat comprises a lower pivotally-connecting portion having a front surface;

a rear surface; the two second lower rods respectively and pivotally mounted at the front surface and the rear surface of the lower pivotally-connecting portion; and two lateral surfaces disposed between the front surface and the rear surface.

4. The auto-assembled-and-folded support frame as claimed in claim 1, wherein each one of the multiple linkage assemblies further comprises an engagement mechanism mounted between the connecting seat and the joint seat;

a plug detachably inserted into the engagement mechanism; and when the plug is detached from the engagement mechanism, the engagement mechanism stops the connecting seat and the joint seat, which are attached, from being detached vertically from each other; when the plug is inserted into the engagement mechanism, the engagement mechanism allows the connecting seat and the joint seat, which are attached, to be detached vertically from each other.

5. The auto-assembled-and-folded support frame as claimed in claim 4, wherein the connecting seat comprises a contact recess;

the joint seat comprises a tenon; when the connecting seat and the joint seat are attached to each other, the tenon extends into the contact recess, the tenon being detachable from the contact recess to detach the joint seat and the connecting seat from each other.

6. The auto-assembled-and-folded support frame as claimed in claim 5, wherein the tenon has a clip recess surrounding an outer wall of the tenon;

the engagement mechanism further comprises a lock plate mounted at a bottom end of the joint seat and having a limiting hole penetrating through the lock plate; when the joint seat and the connecting seat are attached to each other, the tenon passing through the limiting hole, and a position of a contour of the limiting hole corresponding to a position of the clip recess;

an elastic element mounted between the lock plate and the tenon, and biasing the lock plate relative to the tenon, such that the contour of the limiting hole of the lock plate extends into the clip recess to prevent the tenon from being detached from the connecting seat; when the plug is inserted into the connecting seat, the plug biasing the lock plate relative to the tenon, such that the contour of the limiting hole of the lock plate is detached from the clip recess to allow the tenon to be detached from the connecting seat.

7. The auto-assembled-and-folded support frame as claimed in claim 6, wherein the connecting seat has a guide recess extending vertically on the connecting seat;

the lock plate has a slot in the contour of the limiting hole of the lock plate and communicating with the guide recess;

the plug is detachably mounted through the slot and the guide recess to push the tenon to move relative to the lock plate.

8. The auto-assembled-and-folded support frame as claimed in claim 6, wherein the tenon has at least one alignment recess in the outer wall of the tenon and extending vertically;

the lock plate has at least one protrusion rib extending from the contour of the limiting hole; after the plug is inserted into the connecting seat to move the lock plate and the tenon relatively, a position of the at least one protrusion rib corresponding to a position of the at least one alignment recess.

9. The auto-assembled-and-folded support frame as claimed in claim 8, wherein the plug has a vertical edge and an inclined edge disposed opposite to each other; the inclined edge contacting the lock plate.

10. The auto-assembled-and-folded support frame as claimed in claim 1, wherein each one of the multiple straight rod assemblies comprises a vertical post having a support disc mounted at a bottom end of the vertical post;

multiple upper contact seats; one end of each one of the multiple upper contact seats mounted at the vertical post; each one of the multiple upper contact seats pivotably connected to the top end of the corresponding at least one first upper rod or connected to the top end of the corresponding second upper rod; and multiple lower contact seats; one end of each one of the multiple lower contact seats mounted at the vertical post; each one of the multiple lower contact seats pivotably connected to the bottom end of the corresponding first lower rod or connected to the bottom end of the corresponding at least one second lower rod.

11. The auto-assembled-and-folded support frame as claimed in claim 9, wherein each one of the multiple straight rod assemblies comprises a vertical post having a support disc mounted at a bottom end of the vertical post;

multiple upper contact seats; one end of each one of the multiple upper contact seats mounted at the vertical post; each one of the multiple upper contact seats pivotably connected to the top end of the corresponding at least one first upper rod or connected to the top end of the corresponding second upper rod; and multiple lower contact seats; one end of each one of the multiple lower contact seats mounted at the vertical post; each one of the multiple lower contact seats pivotably connected to the bottom end of the corresponding first lower rod or connected to the bottom end of the corresponding at least one second lower rod.

12. The auto-assembled-and-folded support frame as claimed in claim 1 further comprising:

a pressure ring assembly comprising a ring body;

multiple support rods; each one of the multiple support rods having an inner end pivotably connected to the ring body;

an outer end pivotably connected to one of the multiple straight rod assemblies;

wherein each one of the multiple straight rod assemblies has an upper portion connected to the at least one first upper rod or the second upper rod;

a lower portion connected to the first lower rod or the at least one second lower rod;

a supporting portion connected to one of the support rods, and disposed between the upper portion and the lower portion.

* * * * *